US012173713B2

(12) United States Patent
Ma et al.

(10) Patent No.: US 12,173,713 B2
(45) Date of Patent: Dec. 24, 2024

(54) COMPRESSOR AND METHOD OF CONTROLLING THE COMPRESSOR

(71) Applicant: Danfoss (Tianjin) Ltd., Tianjin (CN)

(72) Inventors: Lin Ma, Tianjin (CN); Wenhu Yao, Tianjin (CN); Bin Wang, Tianjin (CN); Xiaoxin Liu, Tianjin (CN)

(73) Assignee: DANFOSS (TIANJIN) LTD., Tianjin (CN)

( * ) Notice: Subject to any disclaimer, the term of this patent is extended or adjusted under 35 U.S.C. 154(b) by 36 days.

(21) Appl. No.: 17/562,324

(22) Filed: Dec. 27, 2021

(65) Prior Publication Data

US 2022/0205447 A1 Jun. 30, 2022

(30) Foreign Application Priority Data

Dec. 29, 2020 (CN) ..... 202011611164.X

(51) Int. Cl.

| | |
|---|---|
| ***F04C 29/00*** | (2006.01) |
| ***F04B 49/22*** | (2006.01) |
| ***F04C 18/02*** | (2006.01) |
| ***F04C 28/24*** | (2006.01) |
| ***F04C 29/04*** | (2006.01) |

(52) U.S. Cl.

CPC ..... *F04C 29/0014* (2013.01); *F04B 49/22* (2013.01); *F04C 28/24* (2013.01); *F04C 29/042* (2013.01); *F04C 18/0207* (2013.01); *F04C 18/0215* (2013.01); *F04C 2270/585* (2013.01)

(58) Field of Classification Search

CPC ..... F04C 18/0207–0215; F04C 28/24; F04C 29/0007–0014; F04C 29/042; F04C 49/22

See application file for complete search history.

(56) References Cited

U.S. PATENT DOCUMENTS

| | | | | |
|---|---|---|---|---|
| RE30,499 E * | 2/1981 | Moody, Jr. | ..... | F04C 29/0014 62/505 |
| 4,974,427 A * | 12/1990 | Diab | ..... | F25B 31/008 62/505 |
| 5,640,854 A * | 6/1997 | Fogt | ..... | F25B 31/008 62/505 |
| 6,350,111 B1 * | 2/2002 | Perevozchikov | ..... | F04C 23/008 418/55.6 |
| 8,424,326 B2 | 4/2013 | Mitra et al. | | |
| 10,047,989 B2 | 8/2018 | Huff et al. | | |

(Continued)

FOREIGN PATENT DOCUMENTS

| | | |
|---|---|---|
| CN | 1311397 A | 9/2001 |
| CN | 100386512 C | 7/2006 |

(Continued)

OTHER PUBLICATIONS

First Examination Report for Indian Patent Application No. 202114060292 dated Jul. 19, 2022.

*Primary Examiner* — Alexander B Comley

(74) *Attorney, Agent, or Firm* — McCormick, Paulding & Huber PLLC

(57) ABSTRACT

A compressor includes a housing, in which a compression chamber is provided; an injection pipeline installed in the housing and configured to inject a fluid into the compression chamber; and a solenoid valve installed on the injection pipeline in the housing and configured to allow or block off the injection of the fluid through the injection pipeline.

11 Claims, 3 Drawing Sheets

(56) References Cited

U.S. PATENT DOCUMENTS

| | | | | |
|---|---|---|---|---|
| 2004/0184930 | A1* | 9/2004 | Millet | G05B 23/0291 417/286 |
| 2008/0184733 | A1* | 8/2008 | Skinner | F04C 18/0215 62/505 |

FOREIGN PATENT DOCUMENTS

| | | | | |
|---|---|---|---|---|
| CN | 101205916 | A | | 6/2008 |
| CN | 101443609 | A | | 5/2009 |
| CN | 101715516 | A | | 5/2010 |
| CN | 102052312 | A | | 5/2011 |
| CN | 201982305 | U | | 9/2011 |
| CN | 102317630 | A | | 1/2012 |
| CN | 102705237 | A | | 10/2012 |
| CN | 103375408 | A | | 10/2013 |
| CN | 103562656 | A | | 2/2014 |
| CN | 104279783 | A | | 1/2015 |
| CN | 102575886 | B | | 8/2015 |
| CN | 108204272 | B | | 6/2018 |
| CN | 209444559 | A | | 9/2019 |
| CN | 210949108 | U | | 7/2020 |
| JP | 2003097477 | A | | 4/2003 |
| JP | 2020002947 | A | * | 1/2020 |
| WO | 2019069441 | A1 | | 4/2019 |

* cited by examiner

COMPRESSOR AND METHOD OF CONTROLLING THE COMPRESSOR

CROSS-REFERENCE TO RELATED APPLICATION

The present disclosure claims the benefit of Chinese Patent Application No. CN202011611164.X filed on Dec. 29, 2020 in the China National Intellectual Property Administration, the whole disclosure of which is incorporated herein by reference.

BACKGROUND OF THE INVENTION

Technical Field

The present application relates to a compressor and a method of controlling the compressor, and more particularly, to a compressor having an injection pipeline and a method of controlling switching between on and off states the injection pipeline in the compressor.

Background

In order to improve a performance of a compressor, a refrigerant injection pipeline assembly is often provided in the compressor. When the compressor stops working, it is necessary to shut off the injection pipeline simultaneously, otherwise the refrigerant would flow into a compression chamber of the compressor, which will damage compression components of the compressor. In the prior art, an electronic expansion valve is often used to shut off the injection pipeline. However, when a system where the compressor is provided is suddenly powered off, the electronic expansion valve often fails to be turned off. In this case, the refrigerant will still flow into the compression chamber, resulting in a decrease in reliability of the compressor.

In addition, in some cases, the injection pipeline needs to be shut off when the compressor is running. For example, when the compressor is used for heating purposes, the injection pipeline is required to inject the refrigerant into the compressor. However, when the compressor is used for refrigeration purposes, sometimes in order to simplify system settings, the injection pipeline does not need to inject any refrigerant. At this time, the injection pipeline needs to be shut off. For another example, in order to reduce reliability risks, it is also necessary to shut off the injection pipeline when the compressor is operating at a relatively high load. However, since the electronic expansion valve in the prior art is typically arranged outside the compressor, when the injection pipeline is shut off by the electronic expansion valve, it often results in more refrigerant residual remaining in the injection pipeline, that is, there is a relatively large dead volume in the injection pipeline, which will also reduce the performance of the compressor.

SUMMARY

The purpose of the present application is to solve one or more of the above-mentioned problems. According to an embodiment of the present application, a compressor and a method of controlling the compressor are provided.

According to one aspect of the present application, provided is a compressor comprising: a housing, in which a compression chamber is provided; an injection pipeline installed in the housing and configured to inject a fluid into the compression chamber; and a solenoid valve installed on the injection pipeline in the housing and configured to allow or block off the injection of the fluid through the injection pipeline.

According to one aspect of the present application, the solenoid valve is positioned adjacent to an inlet of the compression chamber.

According to one aspect of the present application, the compressor further comprising: a first circuit configured to connect the solenoid valve to a power source of the compressor so that the solenoid valve and the compressor are able to be turned on or turned off simultaneously.

According to one aspect of the present application, the compressor further comprising: a system controller configured to monitor and control an operation of the compressor; and a second circuit configured to connect the solenoid valve to the system controller so that the system controller is able to turn the solenoid valve on or off when the compressor is running.

According to one aspect of the present application, the compressor further comprising: a container installed on the housing and configured to accommodate at least one of the power source and the system controller.

According to one aspect of the present application, the compressor further comprising: a first terminal provided in the container and configured to connect the first circuit to the power source; and a second terminal provided in the container and configured to connect the second circuit to the system controller.

According to one aspect of the present application, the compressor is a scroll compressor, and the fluid is a refrigerant.

According to another aspect of the present application, provided is a method for controlling the compressor according to the above aspects, comprising the steps of: connecting the solenoid valve to a power source of the compressor, and switching between allowing and blocking off the injection of the fluid through the injection pipeline, by turning the solenoid valve on in response to a switch-on of the compressor and turning the solenoid valve off in response to a switch-off of the compressor.

According to another aspect of the present application, the compressor further comprises a system controller configured to monitor and control an operation of the compressor, and the method further comprising the steps of: connecting the solenoid valve to the system controller, and switching between allowing and blocking off the injection of the fluid through the injection pipeline by controlling a switching action of the solenoid valve between on and off states by the system controller when the compressor is running.

According to another aspect of the present application, the step of controlling the switching action of the solenoid valve between on and off states by the system controller comprises the step of: controlling a switching action of the solenoid valve between on and off states by sending a switch signal by the system controller.

DETAILED DESCRIPTION

Figure 1:
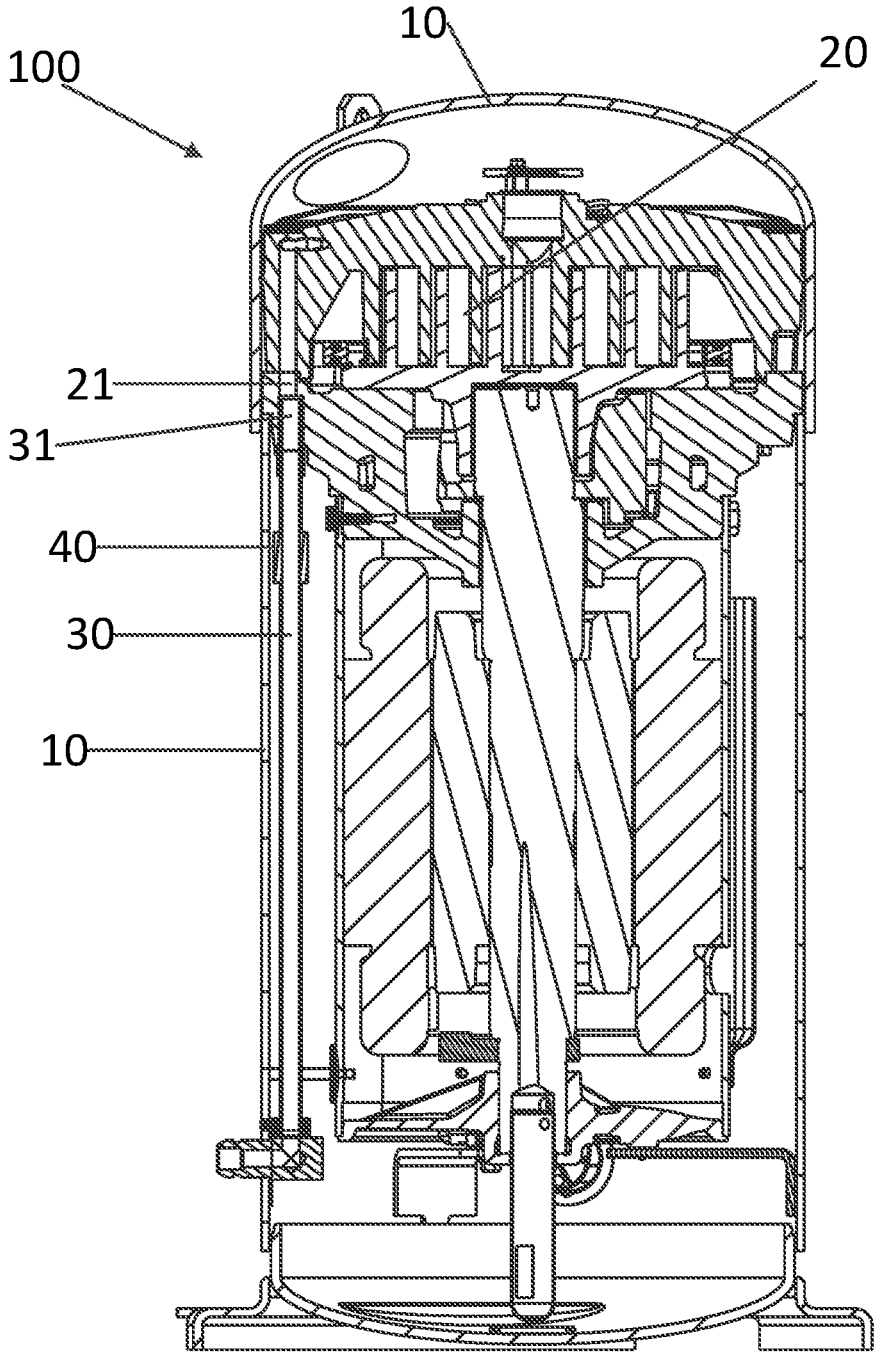
FIG. 1 is a cross-sectional view of a compressor according to an embodiment of the present application.

The technical solutions of the present disclosure will be further specifically described below by way of embodiments and with reference to the accompanying drawings. In the specification, the same or similar reference numerals indicate the same or similar components. The description of the embodiments of the present disclosure with reference to the accompanying drawings is intended to explain the general inventive concept of the present disclosure, and should not be construed as a limitation of the present disclosure.

In addition, in the following detailed description, numerous specific details are set forth to facilitate explanation so as to provide a comprehensive understanding of embodiments of the disclosure. Obviously, however, one or more embodiments may be practiced without these specific details. In other instances, well-known structures and devices are shown by way of illustration to simplify Figures.

Figure 2:
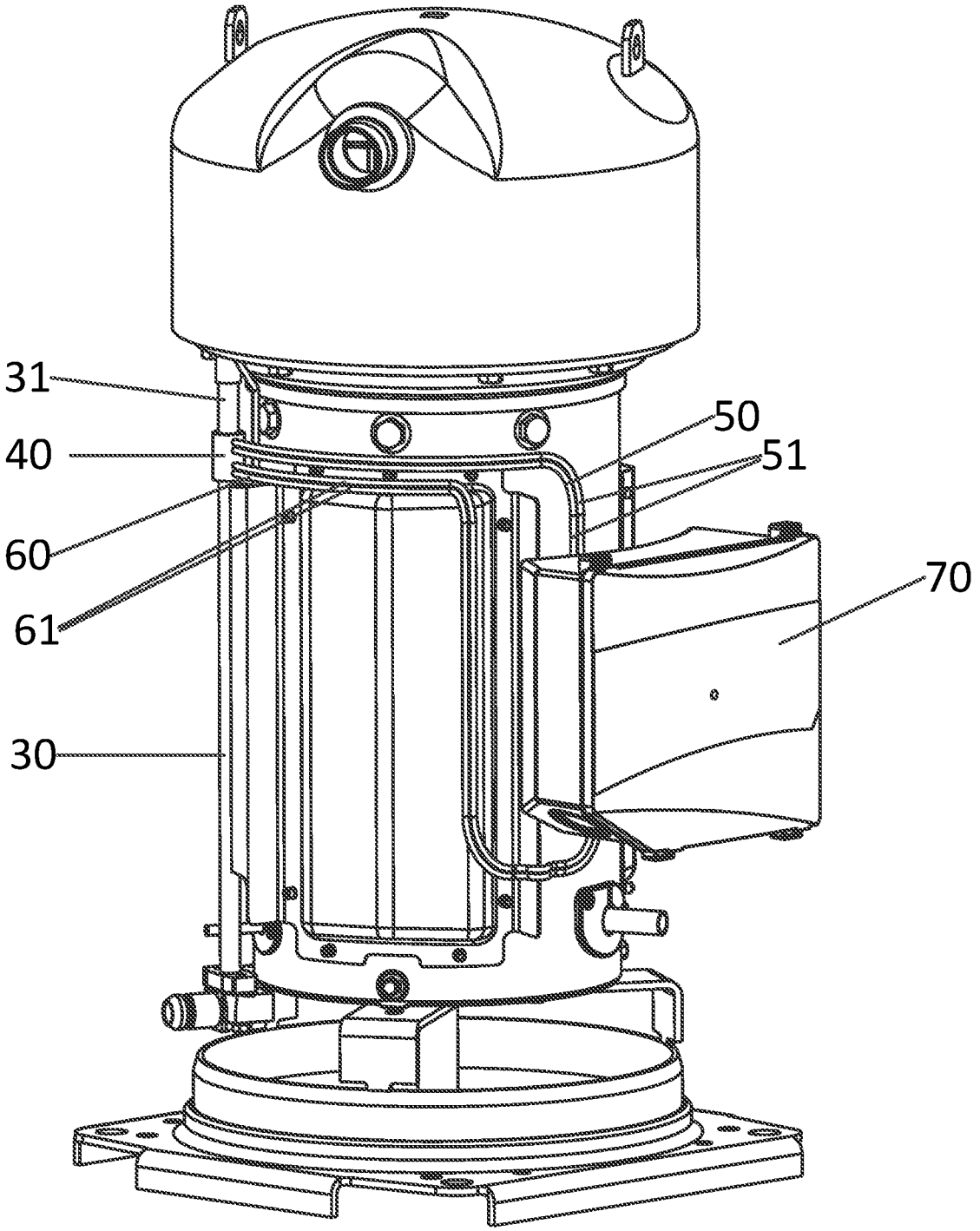
FIG. 2 is a perspective view of a compressor with a part of the housing removed according to an embodiment of the present application.
Figure 3:
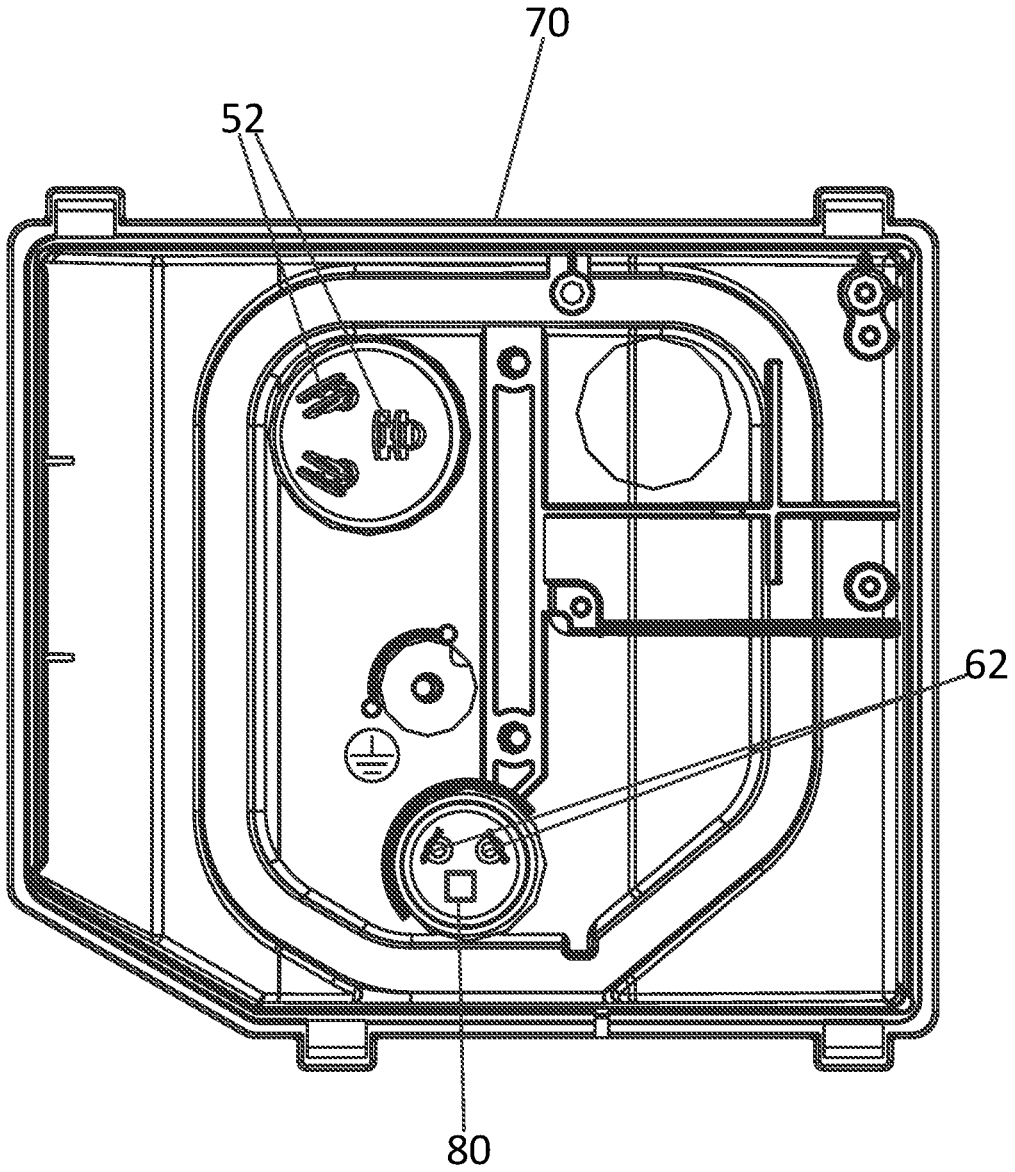
FIG. 3 is a top view of a container of the compressor in FIG. 2 with a top cover removed.

FIG. 1 is a cross-sectional view of a compressor 100 according to an embodiment of the present application; FIG. 2 is a perspective view of a compressor 100 with a part of the housing 10 removed according to an embodiment of the present application; and FIG. 3 is a top view of a container of the compressor 100 in FIG. 2 with a top cover removed.

Referring to FIG. 1, according to an embodiment of the present application, a compressor 100 is provided, comprising: a housing 10 in which a compression chamber 20 is provided; and an injection pipeline 30 installed in the housing 10 and configured to inject a fluid into the compression chamber 20; and a solenoid valve 40 installed on the injection pipeline 30 in the housing 10 and configured to allow or block off the injection of the fluid through the injection pipeline 30. That is, as the compressor 100 is turned on, the solenoid valve 40 may control the injection pipeline 30 to initiate/activate the injection of the fluid therethrough, and as the compressor 100 is turned off, the solenoid valve 40 may control the injection pipeline 30 to stop/deactivate the injection of the fluid therethrough.

Therefore, the solenoid valve 40 may completely shut off the injection pipeline 30 when a system (for example, an air conditioning system) where the compressor 100 is provided is suddenly powered off, thereby fundamentally solving the problems in the prior art that the injection pipeline 30 may not be completely shut off when the system is suddenly powered off and eliminating a risk that the fluid (such as refrigerant and the like) would still migrate into the compression chamber 20 when the system is suddenly powered off and thus would in turn cause a decrease in reliability of the compressor. In addition, the electronic expansion valve used to control the injection pipeline in the prior art is often installed outside the compressor, resulting in a relatively complicated overall structure of the compressor. In contrast, in the present application, the solenoid valve 40 is installed on the injection pipeline in the housing 10, which may effectively simplify the structure of the compressor and a fluid injection path.

Referring to FIGS. 1 to 2, according to an embodiment of the present application, one end 31 of the injection pipeline 30 is adjacent to an inlet 21 of the compression chamber 20 to feed the fluid into the compression chamber 20. The solenoid valve 40 is located at or in the vicinity of the end 31, so that the solenoid valve 40 is positioned close to the inlet 21 of the compression chamber 20, so that when the system in which the compressor 100 is provided is suddenly powered off, the solenoid valve 40 may be turned off simultaneously, thereby minimizing the fluid entering the compression chamber 20. In addition, the solenoid valve 40 being positioned adjacent to the inlet 21 of the compression chamber 20 may also minimize the dead volume of the compressor 100, which is beneficial to improve the performance of the compressor.

Referring to FIG. 2, according to an embodiment of the present application, the compressor 100 further comprises a first circuit 50 comprising two electric wires 51 for connecting the solenoid valve 40 to a power source of the compressor 100, so that the solenoid valve 40 may be turned on and/or off together with the compressor 100. By setting the first circuit 50, the injection pipeline 30 may be switched on and/or off depending on a running or an operating state of the compressor 100, which may completely eliminate the risk that the fluid would still flow into the compression chamber 20 when the system where the compressor 100 is provided is suddenly powered off and thus would cause damage to the compression components of the compressor.

According to an embodiment of the present application, the compressor 100 further comprises a system controller 80 for monitoring and controlling the running or operating state of the compressor. The system controller 80 may be provided on the compressor, or may also be a system controller of an equipment to which the compressor is applied (i.e., the system where the compressor is provided, e.g., an air conditioner), that is, the system controller 80 may also be provided on the equipment.

According to an embodiment of the present application, the compressor 100 further comprises: a second circuit 60 comprising two electric wires 61 for connecting the solenoid valve 40 to the system controller 80. It should be noted that the system controller 80 shown in the figure is schematic, and is only used to illustrate a connection relationship between the system controller 80 and the solenoid valve 40. The system controller 80 may be arranged on the compressor or on other equipment which uses the compressor depending on specific conditions. When the solenoid valve 40 is connected to the system controller 80, the system controller 80 may control the on-off of the solenoid valve 40 (i.e., turn the solenoid valve 40 on and/or off) as required when the compressor 100 is running. By providing the second circuit 60, the dead volume of the compressor in the prior art may be significantly reduced, the performance of the compressor 100 when no fluid injection is required is also improved, and the compressor 100 may be controlled systematically easily.

According to an embodiment of the present application, the compressor 100 further comprises: a container 70 installed on the housing 10 and configured to accommodate at least one of the power source and the system controller 80.

Referring to FIG. 3, according to an embodiment of the present application, the compressor 100 further comprises: a first terminal 52, which is provided in the container 70 and configured to connect the first circuit 50 to the power source.

Referring to FIG. 3, according to an embodiment of the present application, the compressor 100 further comprises: a second terminal 62 provided in the container 70 and configured to connect the second circuit 60 to the system controller 80.

According to an embodiment of the present application, the compressor 100 is a scroll compressor, and the fluid is a refrigerant.

According to an embodiment of the present application, there is provided a method for controlling the compressor 100, comprising: (a) turning the solenoid valve 40 on when the compressor 100 is turned on, by activating the first circuit 50 connecting the solenoid valve 40 to the power source of the compressor 100; and (b) turning the solenoid valve 40 off when the compressor 100 is turned off, by activating the first circuit 50.

According to an embodiment of the present application, after the step of turning the solenoid valve 40 on and before the step of turning the solenoid valve 40 off, the method further comprises: (c) turning the solenoid valve 40 off and/or on by the system controller 80 when the compressor 100 is running, by deactivating the first circuit 50 and activating the second circuit 60 connecting the solenoid valve 40 to the system controller 80 in the compressor 100.

According to an embodiment of the present application, the method further comprises: (d) turning the solenoid valve 40 off when the compressor 100 is turned off, by activating the first circuit 50 and deactivating the second circuit 60.

The user may select and set an execution sequence of the method of controlling the compressor 100 according to specific requirements. When the compressor 100 needs to be controlled systematically, steps (a), (c), (b) or (a), (c), (d) are selected to be executed in sequence in order to accurately control the solenoid valve 40, thereby improving the reliability and other performance of the compressor 100. When the compressor 100 does not need to be controlled systematically, choosing to execute steps (a) and (b) in sequence is also beneficial to improve the reliability of the compressor 100.

That is, when the system where the compressor 100 is provided (that is, the equipment to which the compressor is applied, e.g., an air conditioner) is suddenly powered off, the compressor will also be deactivated at this time. In this case, the step of turning the solenoid valve off is performed. When the system is restarted, the compressor is also restarted, in this case the step of turning the solenoid valve on is performed.

When the system where the compressor 100 is provided (that is, the equipment to which the compressor is applied, e.g., an air conditioner) is in normal operation, the compressor 100 is also in normal operation at this time, if the user needs to shut off the injection pipeline to stop the injection of the fluid into the compressor at this time, then for example a switch signal is sent by the system controller 80 to turn the solenoid valve off. When the user needs to reopen the injection pipeline to inject the fluid into the compressor, then a switch signal is also similarly sent by the system controller 80 to turn the solenoid valve on.

It will be understood by those skilled in the art that the embodiments described above are exemplary and may be modified by those skilled in the art, and the structures described in the various embodiments may be combined freely without conflict in structure or principle thereof.

After explaining the preferable embodiments of the present disclosure in detail, the person skilled in the art may distinctly may find out that various changes and modifications may be made without departing from the scope and spirit of the appended claims. The present disclosure is not limited to the embodiments of the exemplary embodiments set forth in the specification.

What is claimed is:

1. A compressor comprising:

a housing, in which a compression chamber is provided;

an injection pipeline installed in the housing and configured to inject a fluid into the compression chamber;

a solenoid valve installed on the injection pipeline in the housing and configured to allow or block off injection of the fluid through the injection pipeline;

a first circuit configured to connect the solenoid valve to a power source of the compressor so that the solenoid valve and the compressor are able to be turned on or turned off simultaneously and when the compressor is turned off, the solenoid valve is able to simultaneously block off injection of the fluid through the injection pipeline to the compression chamber;

a system controller configured to monitor and control an operation of the compressor; and a second circuit configured to connect the solenoid valve to the system controller so that the system controller is able to turn the solenoid valve on or off when the compressor is running;

wherein the first circuit is activated when the solenoid valve and compressor are simultaneously turned on, and the first circuit is activated when the solenoid valve and compressor are simultaneously turned off; and wherein two electric wires of the first circuit lead into the solenoid valve and two electric wires of the second circuit lead into the solenoid valve.

2. The compressor according to claim 1, wherein:

the solenoid valve is positioned adjacent to an inlet of the compression chamber.

3. The compressor according to claim 2, wherein the compressor is a scroll compressor, and the fluid is a refrigerant.

4. The compressor according to claim 1, further comprising:

a container installed on the housing and configured to accommodate at least one of the power source and the system controller.

5. The compressor according to claim 4, further comprising:

a first terminal provided in the container and configured to connect the first circuit to the power source; and a second terminal provided in the container and configured to connect the second circuit to the system controller.

6. The compressor according to claim 5, wherein the compressor is a scroll compressor, and the fluid is a refrigerant.

7. The compressor according to claim 4, wherein the compressor is a scroll compressor, and the fluid is a refrigerant.

8. The compressor according to claim 1, wherein the compressor is a scroll compressor, and the fluid is a refrigerant.

9. A method for controlling the compressor according to claim 1, comprising the steps of:

connecting the solenoid valve to a power source of the compressor, and switching between allowing and blocking off the injection of the fluid through the injection pipeline, by turning the solenoid valve on in response to a switch-on of the compressor and turning the solenoid valve off in response to a switch-off of the compressor, so that when the compressor is turned off, the solenoid valve is able to simultaneously block off injection of the fluid through the injection pipeline to the compression chamber.

10. The method according to claim 9, wherein the compressor further comprises a system controller configured to monitor and control an operation of the compressor, and the method further comprising the steps of:

connecting the solenoid valve to the system controller, and switching between allowing and blocking off the injection of the fluid through the injection pipeline by controlling a switching action of the solenoid valve between on and off states by the system controller when the compressor is running.

11. The method according to claim 10, wherein the step of controlling the switching action of the solenoid valve between on and off states by the system controller comprises the step of:

controlling a switching action of the solenoid valve between on and off states by sending a switch signal from the system controller.

* * * * *